US008657435B2

(12) United States Patent
Usuda et al.

(10) Patent No.: US 8,657,435 B2
(45) Date of Patent: Feb. 25, 2014

(54) PRINTING APPARATUS AND PRINTING METHOD

(75) Inventors: Hidenori Usuda, Matsumoto (JP); Shinichi Kamoshida, Saitama (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 13/558,186

(22) Filed: Jul. 25, 2012

(65) Prior Publication Data

US 2013/0027460 A1 Jan. 31, 2013

(30) Foreign Application Priority Data

Jul. 26, 2011 (JP) ..... 2011-163100

(51) Int. Cl.
*B41J 2/01* (2006.01)

(52) U.S. Cl.
USPC ..... 347/102

(58) Field of Classification Search
CPC ..... B41J 2/01; B41J 2/21
USPC ..... 347/9, 16, 37, 101, 102, 104; 430/320
See application file for complete search history.

(56) References Cited

U.S. PATENT DOCUMENTS 7,055,945 B2 * 6/2006 Yoneyama et al. ..... 347/102
7,419,232 B2 * 9/2008 Hoshino ..... 347/5
7,682,013 B2 * 3/2010 Hoshino ..... 347/102

FOREIGN PATENT DOCUMENTS

JP 2003-191594 7/2003

* cited by examiner

*Primary Examiner* — An Do
(74) *Attorney, Agent, or Firm* — Workman Nydegger

(57) ABSTRACT

Disclosed is a printing apparatus that includes color ink nozzle rows that ejects the color inks which are irradiated with light and cured, clear ink nozzle row that is provided in the recording head and ejects the clear ink which is curing with irradiation of a light, and a carriage that is provided with a light irradiation section, wherein a first operation in which the color inks are ejected and the light is irradiated from the light irradiation section to cure the color inks, and after the first operation, a second operation in which clear ink is ejected and then the light is irradiated from a light irradiation section to cure the clear ink are performed, and movement speed of the carriage in the first operation is different from movement speed of the carriage in the second operation.

6 Claims, 13 Drawing Sheets

FIG. 11A

A SCHEMATIC DIAGRAM ILLUSTRATING A STATE OF CLEAR INK LAYER SURFACE IN A CASE WHERE THE CARRIAGE 14 MOVES WITH THE FIRST SPEED V1, WHEN IRRADIATING THE CLEAR INK LAYER BY THE ULTRAVIOLET IRRADIATION UNIT 160

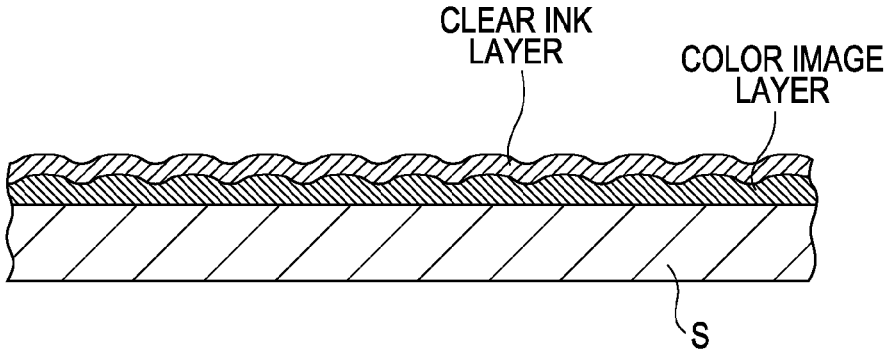

FIG. 11B

A SCHEMATIC DIAGRAM ILLUSTRATING A STATE OF CLEAR INK LAYER SURFACE IN A CASE WHERE THE CARRIAGE 14 MOVES WITH THE SECOND SPEED V2, WHEN IRRADIATING THE CLEAR INK LAYER BY THE ULTRAVIOLET IRRADIATION UNIT 160

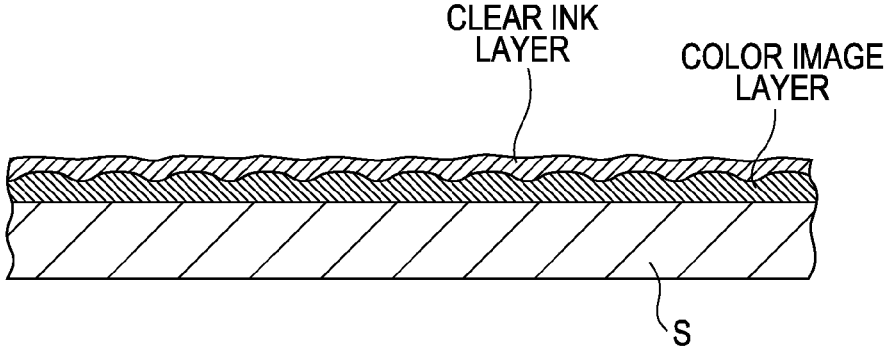

A DIAGRAM ILLUSTRATING SCHEMATICALLY A STATE FORMED CLEAR INK LAYER WITH SMALL SIZED PIXEL

A DIAGRAM ILLUSTRATING SCHEMATICALLY A STATE OF CLEAR INK LAYER SURFACE IN A CASE WHERE THE CARRIAGE 14 MOVES WITH THE FIRST SPEED V1, WHEN IRRADIATING THE CLEAR INK LAYER FORMED WITH SMALL SIZED PIXEL BY THE ULTRAVIOLET IRRADIATION UNIT 160

A DIAGRAM ILLUSTRATING SCHEMATICALLY A STATE FORMED CLEAR INK LAYER WITH LARGEST SIZED PIXEL

A DIAGRAM ILLUSTRATING SCHEMATICALLY A STATE OF CLEAR INK LAYER SURFACE IN A CASE WHERE THE CARRIAGE 14 MOVES WITH THE SECOND SPEED V2, WHEN IRRADIATING THE CLEAR INK LAYER FORMED WITH LARGEST SIZED PIXEL BY THE ULTRAVIOLET IRRADIATION UNIT 160

PRINTING APPARATUS AND PRINTING METHOD

BACKGROUND

1. Technical Field

The invention relates to a printing apparatus of ink jet type printer and a printing method adopted in such a printing apparatus.

2. Related Art

As a printing apparatus, there has been known an ink jet type printing apparatus that ejects ink (liquid) to a recording medium (target).

Among such printing apparatuses, there is a printing apparatus which includes an ejecting section that ejects ink (for example, colored ink) to a medium and an irradiating section that cures the ink by irradiating ultraviolet rays to the inks on the medium. Additionally, through irradiating the ink which is ejected from the ejection section and landed on the medium, the ink is cured and an image is printed. (see, JP-A-2003-191594)

As an image provided by the printing apparatus as described above, the realization of various image representations has been demanded.

Realization of, for example, an image having a glossiness on the surface has been demanded, and in order to respond to the demand, a colorless ink (clear ink) is ejected by the ejection section. Thus, subsequently the colorless ink is ejected onto the colored inks landed on the medium (the ink is cured by irradiation of ultraviolet rays), ultraviolet rays are irradiated to the ink. Thereby a colorless ink layer (flat layer) is formed on the colored inks so that an image having a glossiness as a whole is printed. In addition, there has also been demand to realize an image having a texture. Herein, the image having the texture is referred to as, for example, an image having a stereoscopic effect through the formation of convexities and concavities on the surface.

However, in the related art, the printing apparatus of ink jet type cannot mix an area having a texture and an area having a glossiness in the image. Thus, there is a problem that there are limits to the image representation.

SUMMARY

According to an aspect of the invention, there is provided a printing apparatus includes: a carriage that is movable in a first direction with respect to a medium; a recording head that is provided in the carriage and ejects color inks or a clear ink which are irradiated with light and cured; color ink nozzle rows that are provided in the recording head and ejects the color inks which are irradiated with light and cured; a clear ink nozzle row that is provided in the recording head and ejects the clear ink which is irradiated with light and cured; a moving mechanism that causes the medium to move relatively in a second direction intersecting the first direction; a light irradiating section that is provided in the carriage and irradiates light; and a controller, wherein the controller controls to perform a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured, and the first operation is different in movement speed of the aforementioned carriage from the second operation.

According to another aspect of the invention, there is provided a printing apparatus includes: a carriage movable in a first direction with respect to a medium; a recording head that is provided in a carriage and ejects color inks or a clear ink which are irradiated with light and cured; color ink nozzle rows that are provided in a recording head and ejects the color inks which are irradiated with light and cured; a clear ink nozzle row that is provided in a recording head and ejects the clear ink which is irradiated with light and cured; a moving mechanism that causes the medium to move relatively in a second direction intersecting the first direction; a light irradiating section that is provided in the carriage and irradiates light; and a controller, wherein the controller controls to perform a first operation in which the carriage moves in the first direction with a first speed and color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction with a second speed slower than the first speed and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured.

According to still another aspect of the invention, there is provided a printing apparatus includes: a carriage that is movable in a first direction with respect to a medium; a recording head that is provided in the carriage and ejects color inks or a clear ink which are irradiated with light and cured and is able to form a different size of pixel; color ink nozzle rows that are provided in the recording head and ejects the color inks which are irradiated with light and cured; a clear ink nozzle row that is provided in the recording head and ejects the clear ink which is irradiated with light and cured; a moving mechanism that causes the medium to move relatively in a second direction intersecting the first direction; a light irradiating section that is provided in the carriage and irradiates light; and a controller, wherein the controller controls to perform a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time to cure the clear ink layer, thereby forming a largest sized pixel which is obtained by processing in the second operation, the first operation is different in movement speed of the carriage from the second operation.

According to still another aspect of the invention, there is provided a printing method using: a carriage that is movable in a first direction with respect to a medium; a recording head that is provided in the carriage and ejects color inks or a clear ink which are irradiated with light and cured; color ink nozzle rows that are provided in the recording head and ejects the color inks which are irradiated with light and cured; a clear ink nozzle row that is provided in the recording head and ejects the clear ink which is irradiated with light and cured; a moving mechanism that causes the medium to move relatively in a second direction intersecting the first direction; and a light irradiating section that is provided in the carriage and irradiates light, the method includes; a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured, and the first operation is different in movement speed of the carriage from the second operation.

According to still another aspect of the invention, there is provided a printing method using: a carriage that is movable in a first direction with respect to a medium; a recording head that is provided in the carriage and ejects color inks or a clear ink which are irradiated with light and cured; color ink nozzle rows that are provided in the recording head and ejects the color inks which are irradiated with light and cured; a clear ink nozzle row that is provided in the recording head and ejects the clear ink which is irradiated with light and cured; a moving mechanism that causes the medium to move relatively in a second direction intersecting the first direction; and a light irradiating section that is provided in the carriage and irradiates light, the method includes; a first operation in which the carriage moves in the first direction with a first speed and color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction with a second speed slower than the first speed and clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured.

According to still another aspect of the invention, there is provided a printing method using: a carriage that is movable in a first direction with respect to a medium; a recording head that is provided in the carriage and ejects color inks or a clear ink which are irradiated with light and cured and is able to form a different size of pixel; color ink nozzle rows that are provided in the recording head and ejects the color inks which are irradiated with light and cured; a clear ink nozzle row that is provided in the recording head and ejects the clear ink which is irradiated with light and cured; a moving mechanism that causes the medium to move relatively in a second direction intersecting the first direction; and a light irradiating section that is provided in the carriage and irradiates light, the method includes; a first operation performs in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time to cure the clear ink layer, thereby forming a largest sized pixel which is obtained by processing in the second operation, the first operation is different in movement speed of the carriage from the second operation.

As above, according to the printing apparatus and printing method of the aspects of the invention, when ejecting the clear ink from the clear ink nozzle row to form the clear ink layer on the medium, since it is constituted such that the carriage on which the light irradiation unit is provided is able to change movement speed, it is possible to mix an area having a texture with an area having a glossiness in the image so that the representation of images provided by the printing apparatus can be diversified.

BRIEF DESCRIPTION OF THE DRAWINGS

The invention will be described with reference to the accompanying drawings, wherein like numbers reference like elements.

FIGS. 11A and 11B are schematic diagrams illustrating differences in surface state due to differences in the printing operation.

DESCRIPTION OF EXEMPLARY EMBODIMENTS

Figure 1:
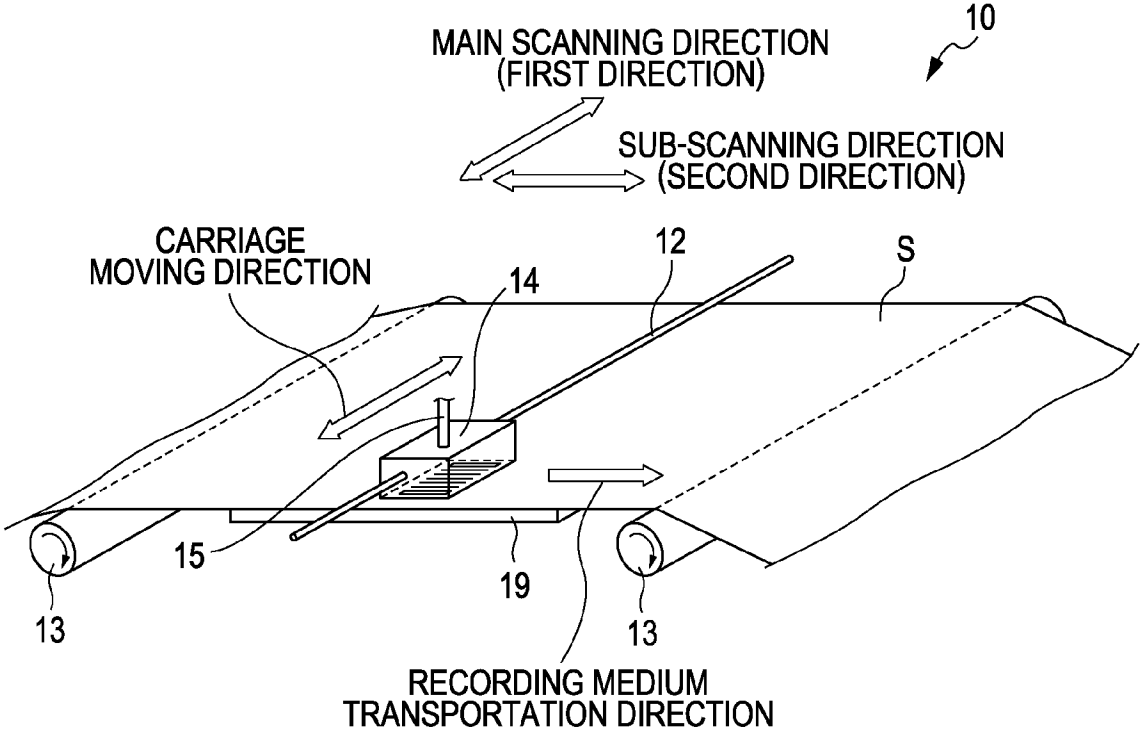
FIG. 1 is a diagram illustrating an outline of a printing apparatus according to an embodiment of the present invention.
Figure 2:
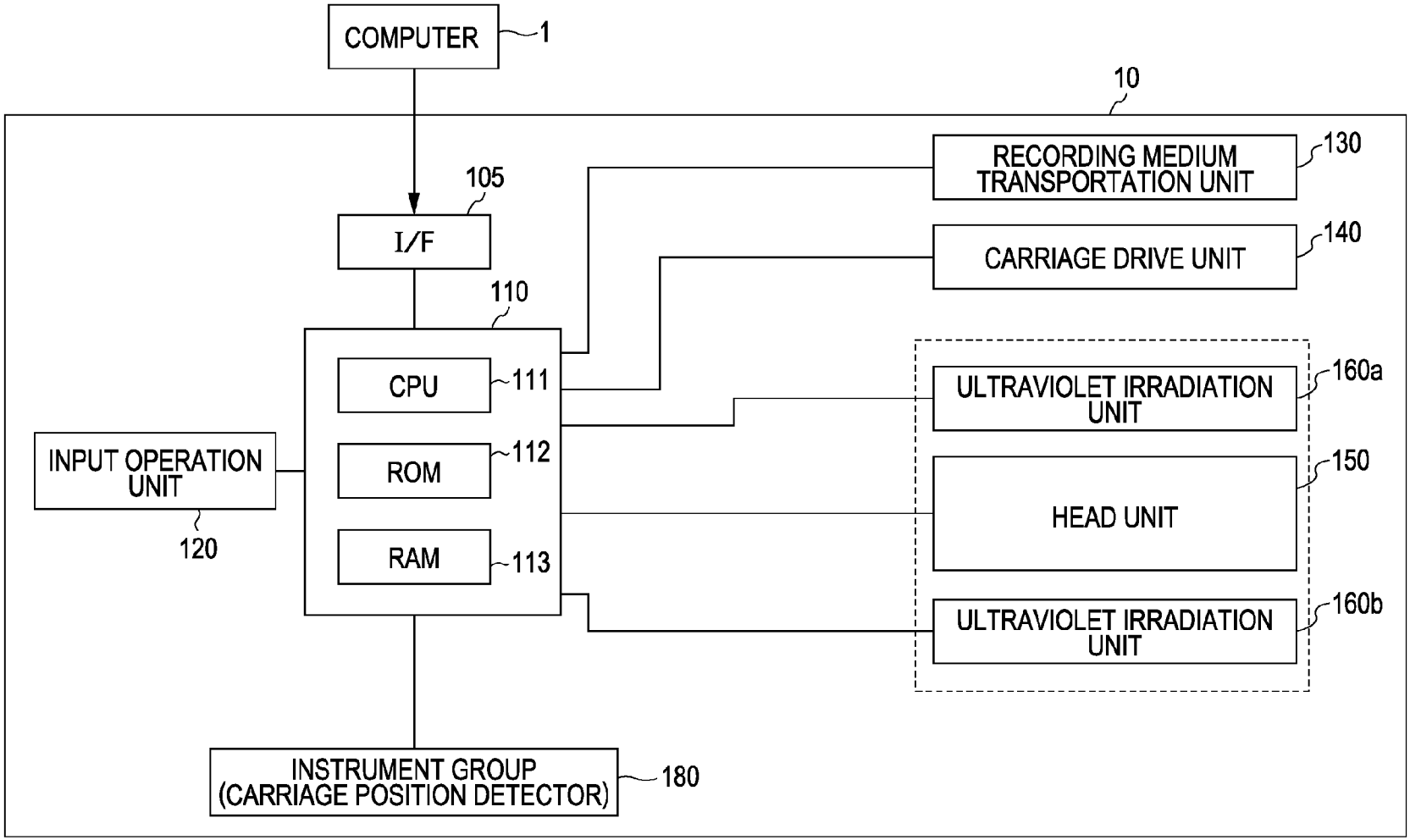
FIG. 2 is a schematic block diagram of an overall configuration of the printing apparatus.
Figure 3:
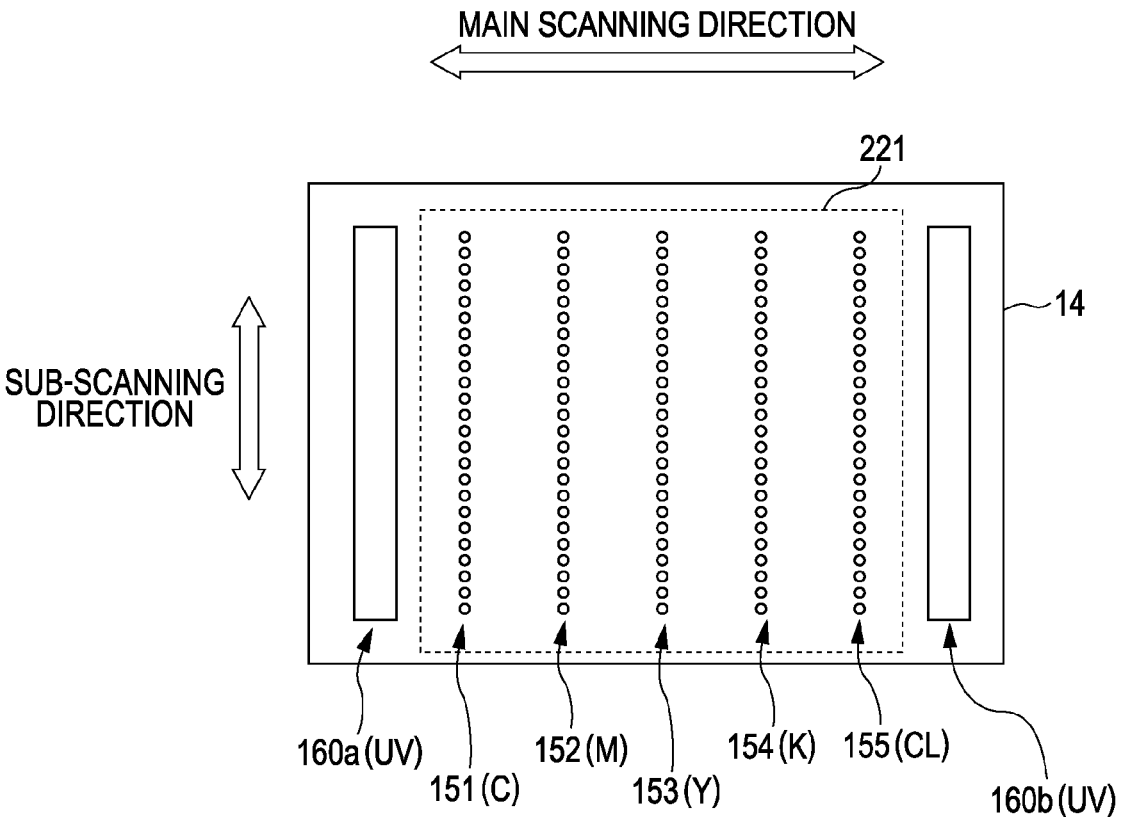
FIG. 3 is a diagram illustrating a head unit and ultraviolet irradiation units which are provided in the carriage of the printing apparatus.

Hereinafter, the embodiment of the invention will be explained with reference to the drawings. FIG. 1 shows an embodiment of the present invention as a diagram illustrating outline of a printing apparatus 10, and shows a serial head-type ink jet recording apparatus. Further, FIG. 2 shows a schematic block diagram of an overall configuration of the printing apparatus 10. Furthermore, FIG. 3 shows a diagram illustrating a head unit 150 and ultraviolet irradiation units 160*a* and 160*b* which are provided in the carriage 14 of the printing apparatus 10.

As shown in FIG. 1, the printing apparatus 10 has a rod-like guide rail 12 on which the carriage 14 is supported. The carriage 14 is constituted to perform a reciprocal movement along the rod-like guide rail 12 in a main scanning direction (first direction) by the carriage drive unit 140 (referring to FIG. 2).

The carriage 14 is provided with a head unit 150 in the central portion thereof, which is made by forming nozzles for ejecting each color inks of yellow (Y), magenta (M), cyan (C), black (K) and clear (CL) to a recording medium S. As inks mainly used for recording images, each color ink of yellow (Y), magenta (M), cyan (C) and black (K) among the inks ejected from the head unit 150 is used to draw a desired image, based on image data received from a computer 1 or the like, which is a higher order device.

Further, based on a clear ink ejection data received from the computer 1 which is a higher order device, the clear (CL) ink is ejected on the image formed from yellow (Y), magenta (M), cyan (C) and black (K) inks from the head unit 150 and thereby a glossiness and a texture are given to the image. The clear (CL) ink is a colorless and transparent ink, while yellow (Y), magenta (M), cyan (C) and black (K) inks are colored inks (color ink). That is to say, the head unit 150 ejects the colored ink and the colorless ink to the recording medium S.

Further, hereinafter, yellow or yellow ink is abbreviated to "Y".

An ink supply tube 15 connected to the carriage 14 is to supply each color of ink from the ink tanks which are not shown in the drawing in the head unit 150.

The computer 1 transmits the image data corresponding to the image which is printing apparatus through the printing apparatus driver to the printing apparatus 10. The image data includes pixel data indicating, for each color of ink, whether or not ink is ejected regarding each pixel of the medium.

Further, the inks used in the embodiment are UV curable inks which are cured through the irradiation of ultraviolet rays. As the UV curable ink, a radical polymerization based ink containing a radical polymeric compound, a cationic polymerization based ink containing a cationic polymeric compound, and a hybrid type ink which is combined from a radical polymerization based ink and a cationic polymerization based ink may be adopted as a polymeric compound. Further, the ink may contain a polymeric compound that is polymerized and is cured by any light other than ultraviolet rays and a photoinitiator that initiates a polymerization reaction between polymeric compounds by any light other than ultraviolet rays for example, an electron beam, X-rays, infrared rays and the like.

Further, as the recording medium S used in the printing apparatus 10 according to the invention, it is possible to adopt a recording medium S formed from various papers such as normal paper, recycled paper and glossy paper and materials such as various fabrics and various non-woven textiles, resins, metals, glasses and resin films. Further, as the resin for resin film, it is possible to adopt PET (Polyethylene terephthalate), PS (polyester), PP (polypropylene) and the like.

The head unit 150 as above is connected to the controller 110 which controls to transmit a drive signal COM, a signal for controlling the ejection of ink and the like to the head unit 150.

In both side portions of the head unit 150 in the carriage 14, ultraviolet irradiation units 160*a* and 160*b*, as a light irradiating device that irradiates ultraviolet rays to inks ejected to the recording medium S from nozzles are provided respectively throughout from the upstream side end in sub-scanning direction (second direction) transporting the recording medium S intersecting a main scanning direction (first direction) in the head to a downstream side end.

The central portion in the movable range of the carriage 14 is a recording area for recording on the recording medium S and in the recording area, a platen 9 supporting the recording medium S horizontally from the non-recording surface side is provided.

Further, the printing apparatus 10 includes a plurality of the transporting rollers 13 and the like and includes the recording medium transportation unit 130 (refer to FIG. 2) for transporting the recording medium S in sub-scanning direction (second direction). The recording medium transportation unit 130, when recording image, transports the recording medium S intermittently while repeating the transportation and stop of the recording medium S from non-recording surface side according to the operation of the carriage 14.

Further, the printing apparatus 10 includes an input operation unit 120 which is constituted by for example, a touch panel on the upper surface of a casing (not shown) thereof and which displays recording modes selectable by a user such that the user selects a mode to be inputted among the displayed modes. The input operation unit 120 is connected to a controller 110 mentioned later and is constituted to output the signal according to the recording mode selected, based on a prescribed operation to controller 110.

FIG. 2 shows a diagram illustrating a control block for controlling the printing apparatus 10 according to the embodiment and in the control block, the controller 110 is constituted by the CPU 111, the ROM 112 and the RAM 113 and is constituted to spread the process program recorded in the ROM 112 in the RAM 113, for example and then to implement the spread process program by the CPU 111. Further, the interface 105 is an interface provided for connecting the controller 110 of the printing apparatus 10 and the computer 1.

According to the process program as mentioned above, The controller 110 is constituted to control the operation of each member, based on running states such as operation conditions of the recording medium transportation unit 130, the carriage drive unit 140, the head unit 150, the ultraviolet irradiation unit 160 and the like. Further, the carriage position detector 180 is constituted by a position detection sensor (not shown) and the like for detecting an origin point position of the carriage 14, thereby is constituted to input the detected information to the controller 110 and to give a help to a driving process of the carriage drive unit 140.

The drive signal creation circuit 117 generates the drive signal COM which is described later. The drive signal creation circuit 117 acquires data according to a waveform of the drive signal COM from the controller 110. Thus, based on the data according to the waveform, a voltage signal is generated and then the drive signal COM is generated by amplifying an electric power of the generated voltage signal. An example of the waveform of drive signal COM will be described later.

The ultraviolet irradiation units 160*a* and 160*b* are devices for curing the UV ink by irradiating ultraviolet rays to the UV ink ejected to the medium. The light source of ultraviolet irradiation units 160*a* and 160*b* is constituted by an UV-LED (Ultra Violet Light Emitting Diode) that generates ultraviolet rays, for example. Thus, it is constituted such that the irradiation rate of ultraviolet rays can be controlled through control by the controller 110. Through such a constitution, it is also possible to change the irradiation amount of ultraviolet rays in each position of the recording medium S. Further, as the light source, it is possible to use another metal halide lamp, a xenon lamp, a carbon arc lamp, a chemical lamp, a low pressure mercury lamp, a high pressure mercury lamp and the like.

In the printing apparatus 10, the controller 110 is constituted to control the head unit 150, the recording medium transportation unit 130 or the like in compliance with the recording mode such that the ejecting order of inks from the head unit 150 is changed and inks are ejected inks to record an image.

Next, an explanation of the head unit 150 mounted on the carriage 14 of the printing apparatus 10 will be described with reference to FIG. 3. FIG. 3 schematically shows the bottom surface (surface opposing the recording medium S) of the carriage 14. As shown in the drawing, the head unit 150 is provided with nozzle rows 151 to 155 that a plurality of nozzles is formed side by side in the sub-scanning direction. In the embodiment, each nozzle row is formed by 180 nozzles. Further, the number of nozzles in the nozzle rows is abbreviated in the drawing. These nozzle rows 151 to 155 correspond to colors of the ink ejected from the head unit 150. That is, the nozzle rows 151 to 155 are constituted by a nozzle row 151 for ejecting the cyan ink, a nozzle row 152 for ejecting the magenta ink, a nozzle row 153 for ejecting the yellow ink, a nozzle row 154 for ejecting the black ink and a nozzle row 155 for ejecting the clear ink.

Further, in the embodiment, the nozzle row corresponding to each ink color is constituted such that nozzles are arranged side by side in a row, but the arrangement of the nozzles in one nozzle row is not specifically limited and, for example, may be constituted such that the nozzles are arranged side by side in a plurality of rows, or the nozzles of a plurality of rows may be arranged in a zigzag pattern.

Further, in the head unit 150 shown in FIG. 3, nozzle rows 151 through 155 are provided in a single head structure body, but it is also possible to constitute so that different head structure bodies which constitute differently each of nozzles in nozzle rows 151 to 155 are provided in the carriage 14. When constituting the different head structure body, it may constitute a single head structure body corresponding to one nozzle row and also constitute a single head structure body corresponding to a plurality of nozzles.

Further, the nozzle rows 151 to 155 are interposed between both ends of the bottom surface of the carriage 14 so that two ultraviolet irradiation units 160*a* and 160*b* are provided. The ultraviolet irradiation units 160*a* and 160*b* use what can irradiate the ultraviolet light with regard to all of inks ejected from nozzle rows 151 to 155 while scanning the carriage 14 in a main scanning direction. The inks are cured by irradiating light using ultraviolet irradiation units 160*a* and 160*b* to the ink ejected from each nozzle row.

The instrument group (carriage position detector) 180 includes a linear encoder (not shown in FIG. 1) for detecting the position of the carriage 14, a rotary type encoder (not shown in FIG. 1) for detecting the rotation amount of the transporting roller 13, a recording medium S detection sensor for detecting positions of the front end and rear end of the recording medium S to be printed, and the like.

The controller 110 controls each unit of the printing apparatus 10 in order to print an image, based on printing data PD sent out from the computer 1 connected to the printing apparatus 10.

Printing apparatus in such a printing apparatus 10, when printing, the recording medium S for printing is transported intermittently with a prescribed transportation amount by the transporting roller 13, and between the intermittent transportations, the carriage 14 ejects the ink toward the recording medium S for printing from the printing head 221 while moving along a direction (first direction) intersecting the transporting direction (second direction) using the transporting roller 13, that is, the CR moving direction. Dots are formed on the recording medium S for printing by the inks ejected to form an image.

Figure 4:
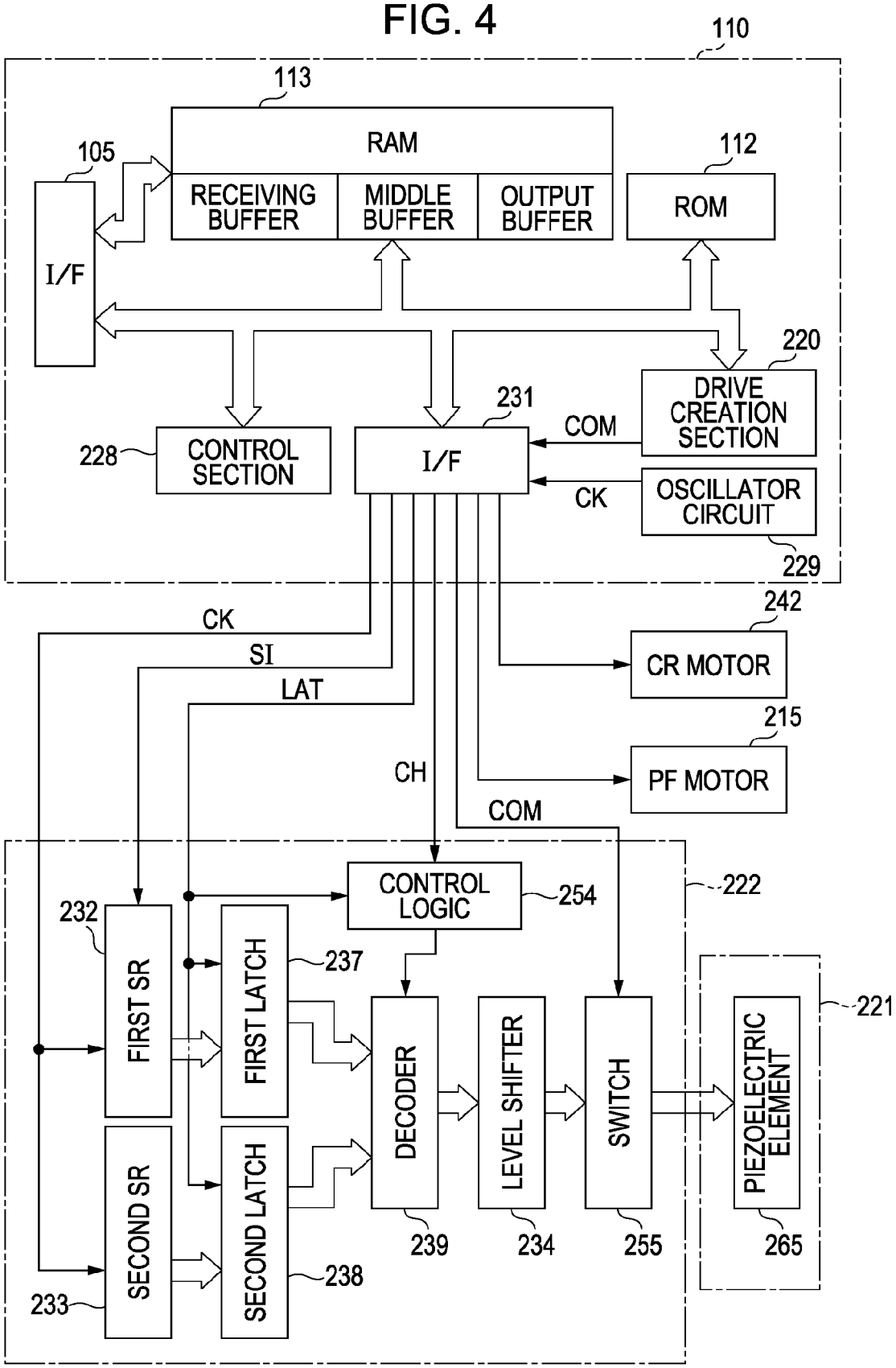
FIG. 4 is a block diagram for explaining more specifically a control roller of the printing apparatus according to the embodiment of the invention.

FIG. 4 shows a block diagram for more specifically explaining a controller of the printing apparatus 10 according to the embodiment of the invention.

The controller 110 includes an external interface 105 (external I/F), a RAM 113 that temporarily stores various data, a ROM 112 that stores a control program and the like, a control section 228 that is constituted by a CPU and the like, an oscillating circuit 229 that generates a clock signal (CK), a drive SIGNAL creation circuit 220 that generates a drive signal (COM) to be supplied to the printing head 221 (details described later), and an internal interface (internal I/F) 231 that transmits dot pattern data (bitmap data) expanded, based on the drive signal, printing data (recording data) or the like to a recording medium transportation unit 130, a head unit 150, a carriage drive unit 140 and the like.

An external I/F 105 receives the printing data which is constituted by for example, character codes, a graphics function, image data and the like from the computer of the outside which is not shown and the like. Further, a busy signal (BUSY) or acknowledgement signal (ACK) is outputted to the computer and the like through the external I/F 105.

The RAM 113 has a receiving buffer, an intermediate buffer, an output buffer and a work memory (not shown). Thus, the receiving buffer temporarily stores the printing data which is received via external I/F 105, the intermediate buffer stores the intermediate code data converted by the control section 228, and the output buffer stores a pixel pattern data. Herein the pixel pattern data is a printing data acquired by decoding (translation) the intermediate code data (for example, gradation data).

The ROM 112 stores font data, graphic function and the like other than a control program (control routine) for performing various data processes. In addition, the ROM 112 stores displacement amount information associated with each nozzle row which is described later and also a drive data table for associating with the drive signal supplying to each nozzle row.

The control section 228 performs various controls according to the control program which is stored in the ROM 112. For example, the printing data in the receiving buffer is read-out as along with the printing data being converted to the intermediate code data, and the converted intermediate code data is stored in the intermediate buffer. Further, the control section 228 interprets the intermediate code data which is read-out from the intermediate buffer and expands (decode) into the pixel pattern data referring to the font data, the graphic function and the like which is stored in the ROM 112. Thus, control section 228 controls to store the pixel pattern data in the output buffer after executing a necessary ornamental process. Each pixel pattern data is gradation information and is consisted of for example, 2 bits data. That is, the control section 228 functions as a gradation data set unit.

If one row of pixel pattern data, which is may be recorded by moving one time in the CR moving direction of the printing head 221, is acquired, the acquired one row of the pixel pattern data is sequentially outputted to the head driver 222 via the internal I/F 231 from the output buffer. If the one row of pixel pattern data is output from the output buffer, the intermediate code data of the expansion termination is cleared from the intermediate buffer and performs an expansion process in the next intermediate code data.

Further, the controller 110 is connected with the recording medium transportation unit 130 and the carriage drive unit 140, and by the controller, a PF motor 215 is driven to transport the recording medium S and a CR motor 242 is driven to move the carriage 14.

The head unit 150 has a printing head 221 and a head driver 222.

FIG. 3 shows a diagram of the printing head 221 viewed from the bottom surface side. In the bottom surface of the printing head 221, a yellow (Y) ink nozzle row, a magenta (M) ink nozzle row, a cyan (C) ink nozzle row, a black (K) ink nozzle row, and a clear (CL) ink nozzle row are provided as the ink ejecting section ejecting the black ink.

A plurality of nozzles in each nozzle row is aligned along the transporting direction of the recording medium. When printing, ink from each nozzle row is ejected while the printing head 221 moves together with the carriage 14 (FIG. 1) in the CR moving direction (first direction). For example, droplet-like ink is ejected from each nozzle. In addition, in this example, a first nozzle is disposed on the upstream side in the transporting direction of the recording medium S.

Figure 5:
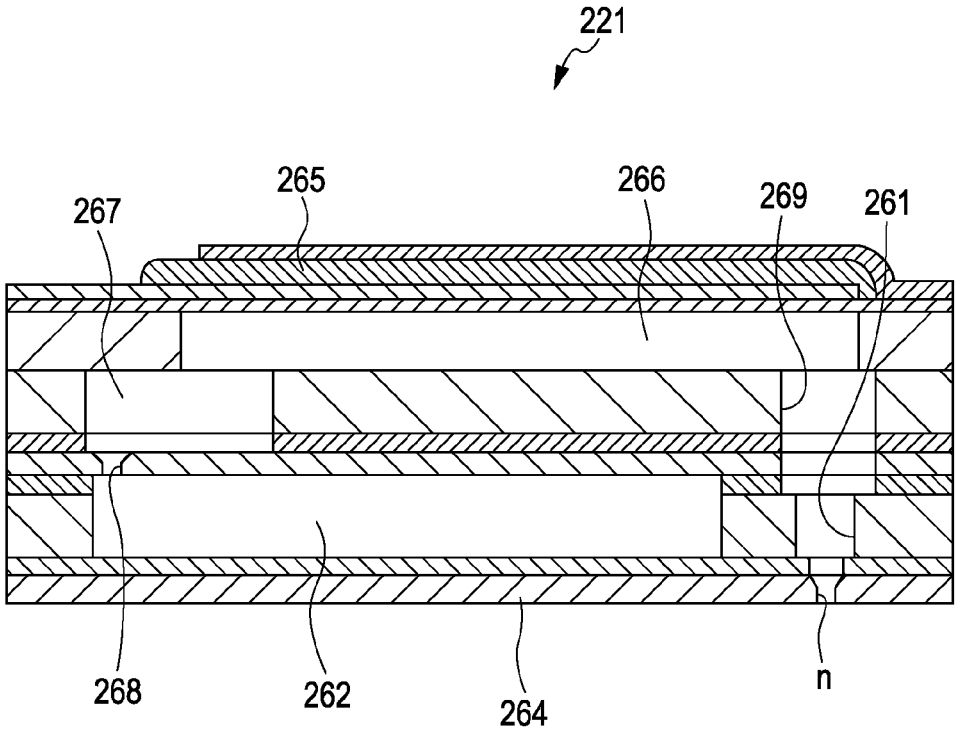
FIG. 5 is a cross-sectional view for illustrating an internal structure of the printing head.

FIG. 5 shows a cross-sectional view for explaining the internal structure of a printing head.

As shown in FIG. 5, the printing head 221 is mainly provided with an ink chamber 262 that is supplied with an ink from ink cartridge (not shown), a nozzle plate 264 that a plurality (for example, 64) of nozzles n is provided in rows in the transporting direction and pressure chambers 266 which are provided in plural according to the number of nozzles n. The pressure chamber 266 is constituted to expand and contract through deformation of a piezoelectric element 265 as the driving element.

The ink chamber 262 and the pressure chamber 266 are communicated with each other via an ink supplying port 267 and a supply side-communication hole 268. Further, the pressure chamber 266 and nozzles n are communicated with each other via a first nozzle communication hole 269 and a second nozzle communication hole 261. That is, a series of ink flow paths reaching the nozzles n via a pressure chamber 266 from the ink chamber 262 is formed for each nozzle n.

In the embodiment, the nozzle plate 264 is constituted as a nozzle plate for processing the waste ink.

The nozzles n are opened with relatively small caliber at the outside surface of the nozzle plate 264 opposing the recording medium S for printing and on the other hand, the nozzles n are opened with relatively large caliber at the back side of nozzle plate on the second nozzle communication hole 261 side. Because of this, the internal side wall surface of the nozzles n has either a funnel shape or a cone shape.

The piezoelectric element 265 is a piezoelectric element 265 of a so-called flexural vibration mode. If the piezoelectric element 265 of a so-called flexural vibration mode is used, the piezoelectric element 265 is shrunk in a direction intersecting an electric field due to an electric charge so that the pressure chamber 266 contracts and if the electrically charged piezoelectric element 265 is discharged, the piezoelectric element 265 extends in a direction intersecting the electric field so that the pressure chamber 266 expands.

That is to say, in the printing head 221, the pressure chamber 266 changes in capacity accompanying the electric charging and discharging with regard to the piezoelectric element 265. By using the pressure change in the pressure chamber 266 in this way, it is possible to eject ink droplets from nozzles n.

Further, instead of the piezoelectric element 265 of the flexural vibration mode, it is also possible to use a piezoelectric vibrator of a longitudinal vibration mode. The piezoelectric vibrator of the longitudinal vibration mode is a piezoelectric vibrator which makes the pressure chamber expand due to a deformation by the electric charging and which makes the pressure chamber 266 shrink due to a deformation through the electric discharging.

The printing apparatus 10 that is constituted as above ejects droplet-like ink from the printing head 221 in synchronization with each reciprocal movement of the carriage 14 during the recording operation. Meanwhile, the transporting roller 13 is rotated during the switchover between the outward movement and inward movement of the carriage 14 to move the recording medium S to be printed by a setting line width in a transporting direction. As a result, on the recording medium S for printing, an image, characters or the like is recorded, based on the printing data.

As shown in FIG. 5, the head driver 222 is provided with a shift register circuit which is consisted of a first shift register ($1^{st}$ SR) 232 and a second shift register ($2^{nd}$ SR) 233, a latch circuit which consists of a first latch circuit 237 and a second latch circuit 238, a decoder 239, a control block 254, a level shifter 234 and a switch circuit 255.

Figure 6:
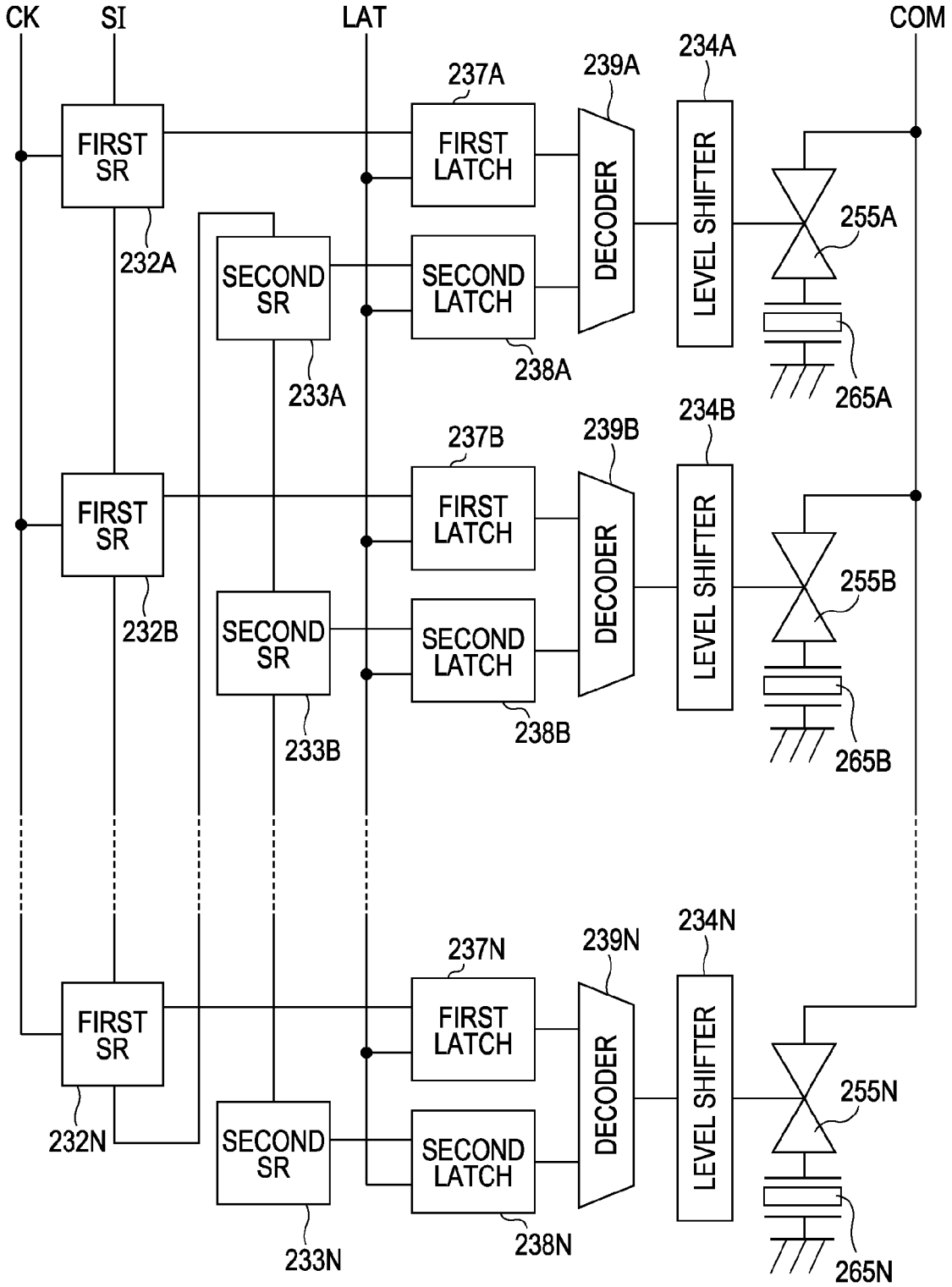
FIG. 6 is a block diagram for illustrating a head driver.

FIG. 6 shows a block diagram for explaining the head driver.

Each shift register, each latch circuit, a decoder and a switch circuit are respectively constituted by the first shift registers 232A to 232N provided for each nozzle n of the printing head 221, the second shift registers 233A to 233N, the first latch circuits 237A to 237N, the second latch circuits 238A to 238N, decoders 239A to 239N and switch circuits 255A to 255N as shown FIG. 6.

The printing head 221 that is driven in the head driver 222 in this way ejects ink droplets, based on printing data and timing signals from the controller 110. The printing data (SI) from the controller 110 is transmitted serially from the internal I/F 231 to the first shift register 232 and the second shift register 233 in synchronization with the clock signal (CK) from the oscillator 229.

The printing data from the controller 110 represents each pixel with 2 bits of data. Each pixel is formable as three types of pixel with different sizes through the formation or non-formation of three dots formable using three ink drops. Specifically, each pixel is represented with four gradations of non-formation, a small sized pixel, a medium sized pixel and a large sized pixel, and the printing data is represented in a manner where non-formation is (00), a small sized pixel is (01), a medium sized pixel is (10) and a large sized pixel is (11).

Such printing data is set for each pixel and for each nozzle n. Thus, lower order bit data according to all nozzles n is inputted to the first shift register 232 (232A to 232N) and upper order bit data according to all nozzles n is inputted to the second shift register 233 (233A to 233N).

As shown in FIG. 6, the first latch circuit 237 is electrically connected to the first shift register 232. Similarly, the second latch circuit 238 is electrically connected to the second shift register 233.

Thus, if a latch signal (LAT), which a PTS signal as a reference timing signal from the controller 110 is supplied as a trigger, is inputted to each of latch circuits 237 and 238, the first latch circuit 237 latches the lower order bit data of the printing data and the second latch circuit 238 latches the upper order bit of the printing data.

In this way, a circuit unit that consists of the first shift register 232 and the first latch circuit 237 and another circuit unit that consists of the second shift register 233 and the second latch circuit 238 perform a function as a storage circuit respectively. That is, these circuit units temporarily store the printing data before being inputted to the decoder 239.

The printing data latched by the first latch circuit 237 and the second latch circuit 238 is inputted to decoders 239A to 239N. The decoder 239 translates the two bits of printing data to create a pulse selection data (pulse selection information). The pulse selection data is constituted by a plurality of bits equal to or greater than the gradation data, each bit corresponds to each pulse waveform consisted of the drive signal (COM). Thus, it is constituted such that the supplying/non-supplying of the drive pulse waveform to the piezoelectric element 265 are selected according to the content (for example, (0), (1)) of each bit. In addition, the supplying of the drive signal (CON) and the drive pulse waveform will be described later.

Meanwhile, a latch signal (LAT) and a changing signal (CH) from control logic 254 are also inputted to the decoder 239.

The pulse selection data translated by the decoder 239 is inputted to the level shifter 234 every time when a timing specified by a timing signal is reached in order from the higher order bit side. For example, the highest order bit data of the pulse selection data at a first timing in the recording period is inputted to the level shifter 234 and a second order bit data in the pulse selection data at the second timing is inputted to the level shifter 234.

The level shifter 234 functions as a voltage amplifier and in a case where the pulse selection data is "1", outputs an electric signal stepped up to a voltage, for example, of approximately several tens of volts, by which can drive the switch circuit 255.

The pulse selection data of "1" which is stepped up in the level shifter 234 is supplied to the switch circuit 255 functioning as the drive pulse creation unit and control main body unit. The switch circuit 255 is to select the drive pulse included in the drive signal (COM), based on the pulse selection data created by the translation of the printing data in order to create a drive pulse and also to supply the created drive pulse to the piezoelectric element 265. Accordingly, it is constituted such that the drive signal (COM) from the drive signal creation circuit 220 is supplied to the input side of the switch circuit 255 and the piezoelectric element 265 is connected to its output side.

The pulse selection data controls the operation of the switch circuit 255. For example, during a period that the pulse selection data applied to the switch circuit 255 is "1", the switch circuit 255 is in a connected state and thus the drive pulse of the drive signal is supplied to the piezoelectric element 265. As a result, the electric potential level of the piezoelectric element 265 is changed.

Meanwhile, during a period that the pulse selection data applied to the switch circuit 255 is "0", the electric signal by which operates the switch circuit 255 is not outputted from the level shifter 234. Because of this, the switch circuit 255 is in a disconnected state and thus the drive pulse of the drive signal is not supplied to the piezoelectric element 265. When the pulse selection data is in a period of "0", the piezoelectric element 265 maintains an electric potential level just before the pulse selection data is switched to "0".

In the embodiment, one pixel is formed by a combination of three droplets of ink so that each size of pixel, that is, a large sized pixel, a medium sized pixel and a small sized pixel are formed. Accordingly, a maximum of three droplets of ink are ejected in a period (hereinafter, referred to one pixel period) TW in which inks for forming one pixel can be ejected.

Figure 7:
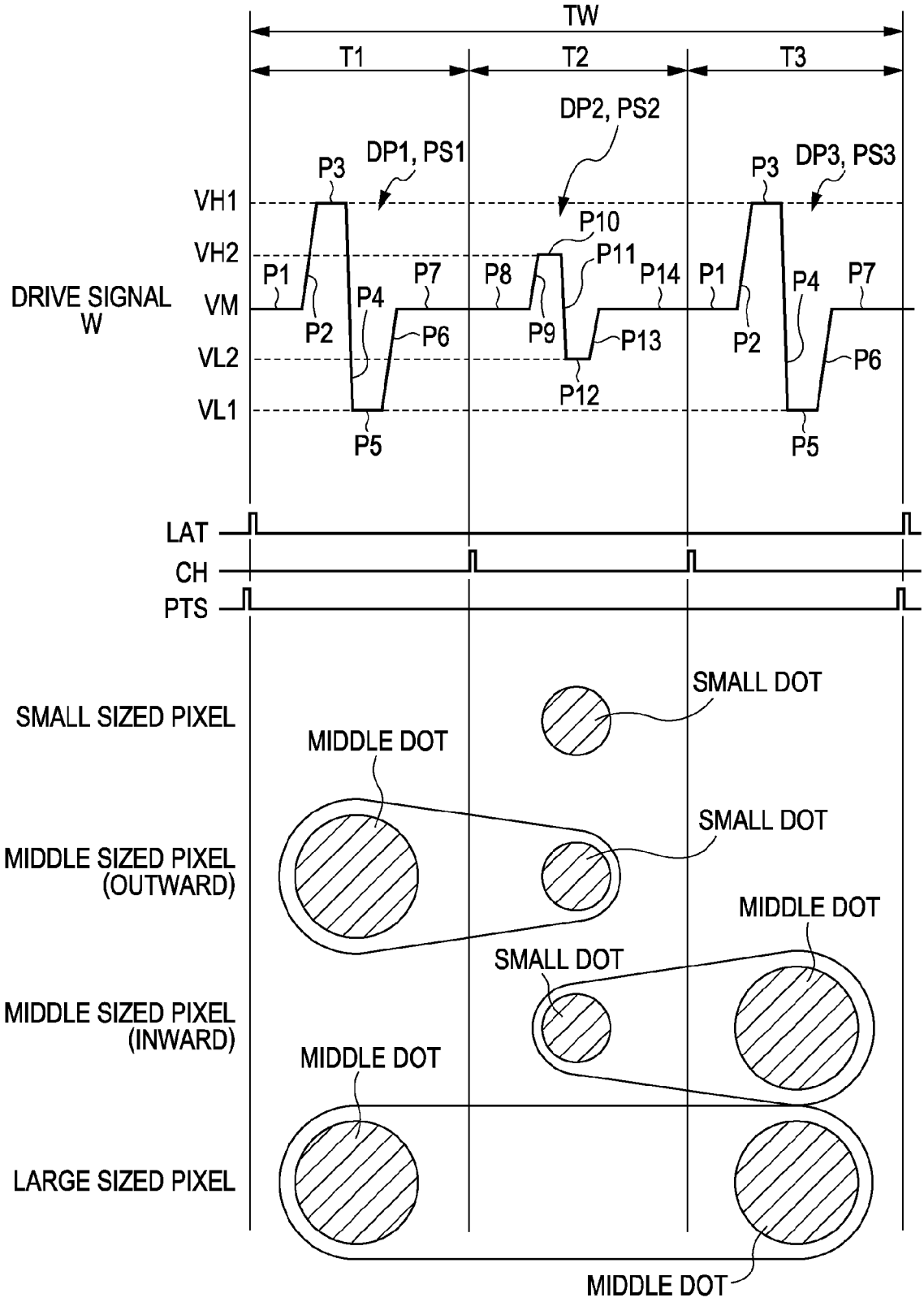
FIG. 7 is a diagram illustrating a reference drive signal for ejecting ink from the nozzle row.

FIG. 7 shows a diagram illustrating reference drive signal for ejecting ink from the nozzle row.

As shown in FIG. 7, a drive signal W has three dot formation signals which are able to form a dot with three droplets of ink in one pixel period. The dot formation signals are a first pulse signal PS1 which is outputted in a period T1, a second pulse signal PS2 which is outputted in a period T2 and a third pulse signal PS3 which is outputted in a period T3, and are pulse train waveform signals which are generated repeatedly in the period TW for forming one pixel.

In the drive signal W, the first pulse signal PS1 is a medium dot drive pulse DP1 for ejecting a medium sized ink droplet from the nozzles n, the second pulse signal PS2 is a small dot drive pulse DP2 for ejecting a small ink droplet from the nozzles n, and the third pulse signal PS3 is a medium dot drive pulse DP3 for ejecting a medium ink droplet from the nozzles n, in similar to the first pulse signal PS1.

Accordingly, as shown in FIG. 7, when forming the large sized pixel, the first pulse signal PS1 and the third pulse signal PS3 are supplied to the piezoelectric element 265 and accordingly, one pixel is formed from two medium. When forming the medium sized pixel, any one of the first pulse signal PS1 and the third pulse signal PS3, and the second pulse signal PS2 are supplied to the piezoelectric element 265 and accordingly, one pixel is formed from 1 medium dot and 1 small dot. At that time, supplying of any of the first pulse signal PS1 and the third pulse signal PS3 is set by the moving direction of the carriage 14. When forming the small sized pixel, the second pulse signal PS2 is supplied to the piezoelectric element 265 and accordingly, one pixel is formed from 1 small dot. In the pixel image view of FIG. 7, the interval between the two dots, which a pixel formed from two dots has, is shown as opened, but actually, one pixel is formed by the spreading or blurring of ink.

The first drive pulse DP1 is constituted by a first hold period P1 that maintains an intermediate electric potential VM from a time point when the latch signal (LAT) for supplying PTS signal is outputted as a trigger to a time point when the change of electric potential is started, a first electric charging period P2 that steps up an electric potential voltage from the intermediate electric potential VM to a first highest electric potential VH1, a second hold period P3 that maintains the first highest electric potential VH1 during a prescribed time, a first electric discharging period P4 that steps down the electric potential in a prescribed time from a first highest electric potential VH1 to a first lowest electric potential VL1, a third hold period P5 that maintains the first lowest electric potential VL1 during a prescribed time, a second electric discharging period P6 that steps up an electric potential with a prescribed time from the first lowest electric potential VL1 to the intermediate electric potential VM and a fourth hold period P7 that maintains the intermediate electric potential VM. Each period constituting a third drive pulse DP3 is similar to the first drive pulse DP1, but differs in that the base point of the first hold period is, instead of the latch signal, a change signal supplied a predetermined time after the PTS signal is outputted. Further, with the first drive pulse DP1 and the third drive pulse DP3, it is possible to set the highest electric potential, the lowest electric potential, the hold time of each hold period, and a time required for electric charging period and the electric discharging period.

If drive pulses DP1 and DP3 are supplied to the piezoelectric element, the quantity of ink droplets, which is acquired to form a medium dot, is ejected from nozzles n. More specifically, after the intermediate electric potential VM is maintained for a prescribed time by the first hold period P1, the first electric charging period P2 is supplied to charge the piezoelectric element 265 from the intermediate electric potential VM. Due to the electric charging, the volume of the pressure chamber 266 expands from the reference volume to the first maximum volume by the first electric discharging period P4. The expansion operation of the pressure chamber 266 is an intake operation in which takes in the ink to the pressure chamber 266. Accordingly, the pressure chamber 266 is contracted rapidly to the first minimum volume. The contracted state of the pressure chamber 266 is maintained over the period that third hold period P5 is supplied. By the rapid contraction of the pressure chamber 266 and the maintaining of the contracted state, medium ink droplets are ejected from nozzles n in which the ink pressure in the pressure chamber 266 is increased rapidly. That is, the contraction operation of the pressure chamber 266 is an extrusion operation in which extrudes ink from the pressure chamber 266. Accordingly, by the second electric charging period P6, the pressure chamber 266 is returned to the expansion so that a vibration of the meniscus is converged in a short time.

The drive pulse DP2 is constituted by a fifth hold period P8 that maintains the intermediate electric potential VM from the time point that a change signal supplied when lapsing of a prescribed time after outputting of PTS signal is outputted to the time point that the change of electric potential is started, a third electric charging period P9 that steps up the electric potential from intermediate electric potential VM to the second highest electric potential VH2, a sixth hold period P10 that maintains the second highest electric potential VH2 for a prescribed time, a second electric discharging period P11 that steps down the electric potential for a prescribed time from the second highest electric potential VH2 to the second lowest electric potential VL2, a seventh hold period P12 that maintains the second lowest electric potential VL2 for a prescribed time, a fourth electric charging period P13 that steps up the electric potential from the second lowest electric potential VL2 to the intermediate electric potential VM for a prescribed time, and an eighth hold period P14 that maintains the intermediate electric potential VM. Accordingly, it is possible to set the highest electric potential, the lowest electric potential, the hold time for each hold period, the electric charging period and a time required for the electric discharging period, with the second drive pulse DP2.

If drive pulse DP2 is supplied to the piezoelectric element 265, a quantity of ink droplet, which is acquired in order to form a small dot, is ejected from nozzles n. More specifically, after that the intermediate electric potential VM is maintained for a prescribed time by the fifth hold period P8, the third electric charging period P9 is supplied so that the piezoelectric element 265 is charged from the intermediate electric potential VM and thereby the volume of the pressure chamber 266 expands from a reference volume to a second maximum volume (intake operation). Then, by the second electric discharging period P11, the pressure chamber 266 contracts rapidly to the second minimum volume. The contracted state of the pressure chamber 266 is maintained over the period that the seventh hold period P12 is supplied. By maintaining the rapid contraction of the pressure chamber 266 and its contracted state, small ink droplets are ejected from the nozzles n in which pressure of the ink in the pressure chamber 266 rises rapidly (extrusion operation). Then, by the fourth electric charging period P13, the pressure chamber 266 is returned to the expansion so that the vibration of the meniscus is converged in a short time.

Figure 8:
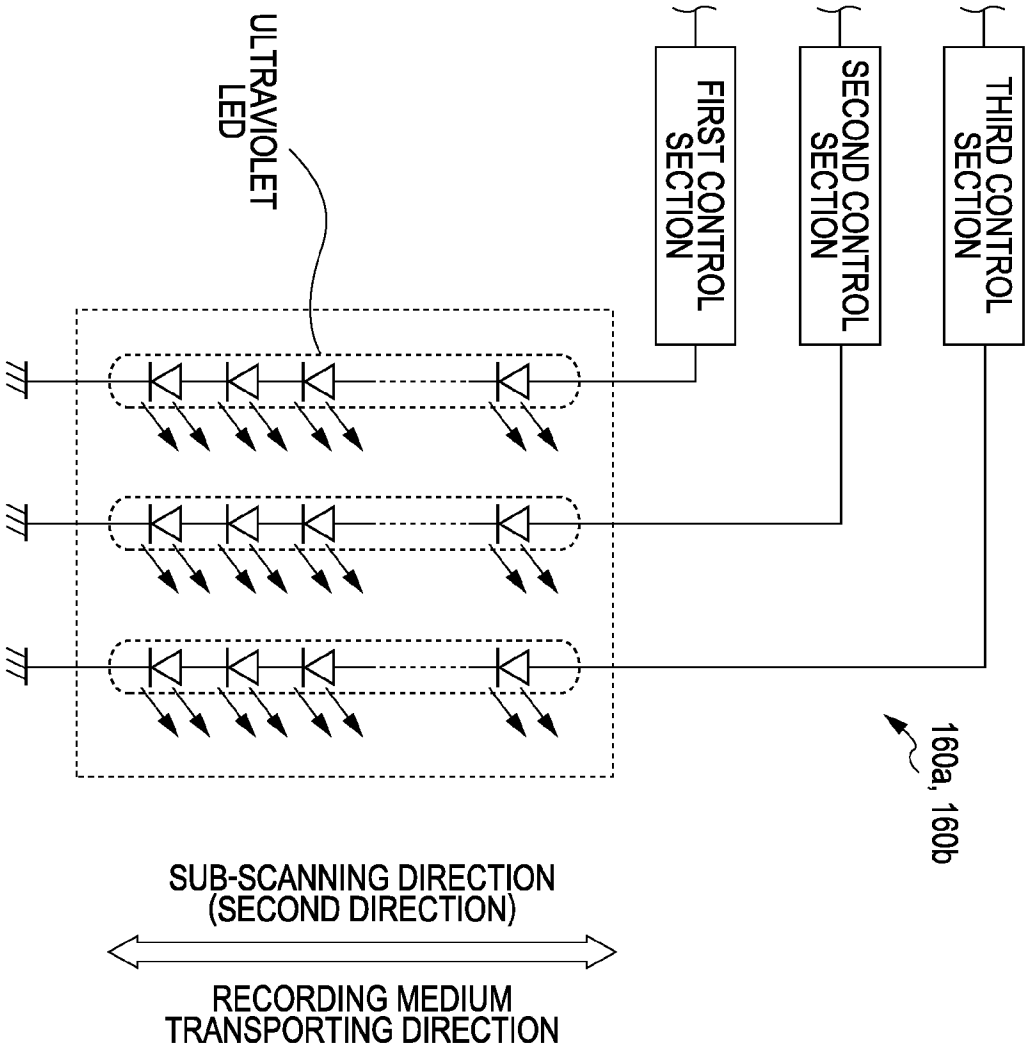
FIG. 8 is a diagram illustrating an example of configuration of ultraviolet irradiation units which are used in the printing apparatus according to the embodiment of the invention.

Next, a configuration example of ultraviolet irradiation units 160*a* and 160*b* adopted to the printing apparatus 10 according to embodiment of the invention will be explained in detail with reference to FIG. 8. FIG. 8 shows a diagram illustrating a configuration example of ultraviolet irradiation units 160*a* and 160*b* adapted to the printing apparatus 10 according to the embodiment of the invention. The ultraviolet irradiation units 160*a* and 160*b* are constituted by a plurality of ultraviolet LEDs serially connected in the second direction which is the sub-scanning direction as shown in FIG. 8. In an example of FIG. 8, the plurality of serially connected ultraviolet LEDs is provided in 3 lines, each line is connected to a first control section, a second control section and a third control section respectively.

When the irradiation strength is controlled by the ultraviolet irradiation units 160*a* and 160*b*, the ultraviolet LEDs of either line are controlled to operate ON-OFF by these control sections, or the ultraviolet LEDs are controlled to operate ON-OFF with same light emitting level by all of the first control section, the second control section and the third control section.

Figure 9A:
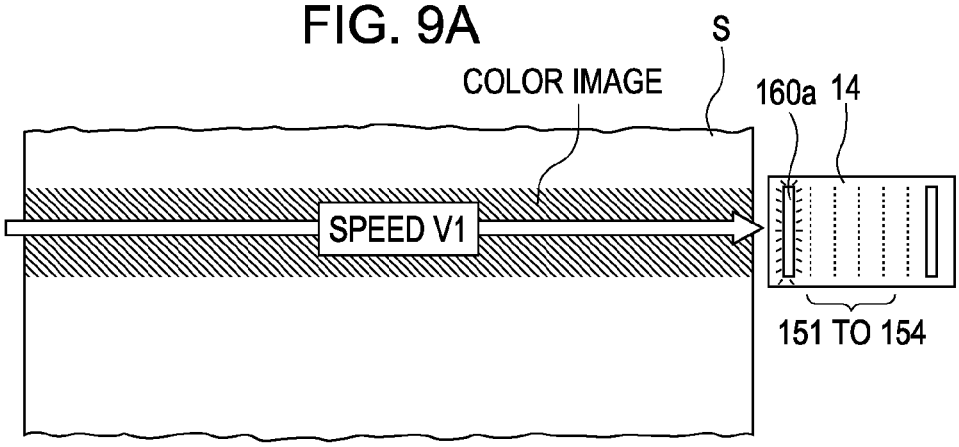
FIGS. 9A to 9C are diagrams illustrating printing operations by the printing apparatus according to the embodiment of the invention.
Figure 9B:
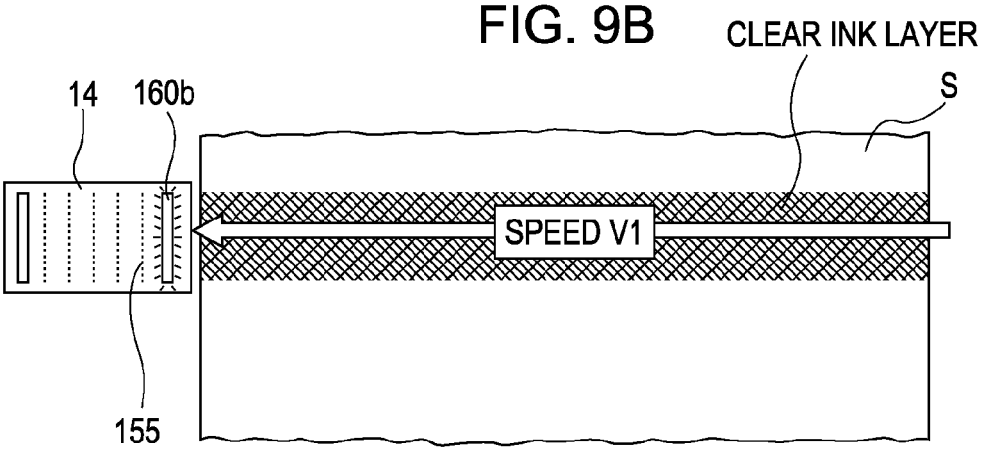
Figure 9C:
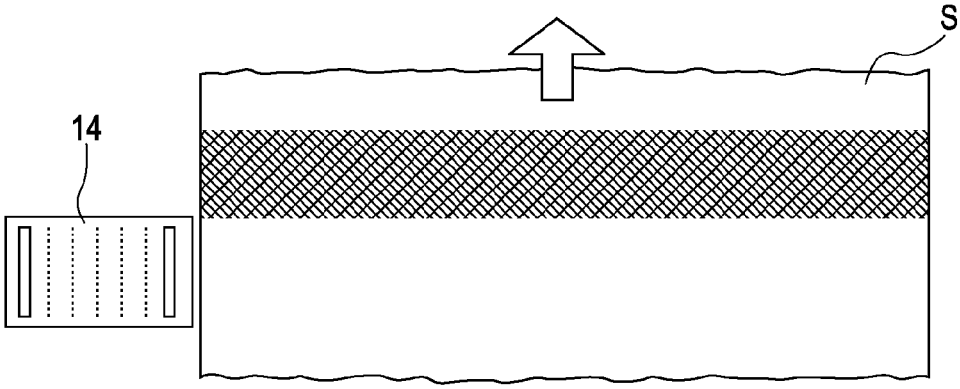

Next, in the printing apparatus 10 constituted as above, the printing operation will be explained referring to FIGS. 9A to 9C. FIGS. 9A to 9C show a drawing of the printing apparatus 10 viewed from the upper side and shows a schematic diagram of the recording medium S and the carriage 14. The left and right direction of the paper is a direction such that the carriage 14 moves in a first direction and the vertical direction of paper is such a direction that the recording medium S is transported in a second direction. Further, FIGS. 9A to 9C represent of the operation in which prints a width (band width) corresponding to the length of nozzle rows 151 to 155 of each inks, which are provided in the carriage 14. FIGS. 9A to 9C show a printing operation using for forming an area having a texture in the image formed on the recording medium S.

Further, as shown in FIG. 9A, the carriage 14 moves in a first direction with a first speed V1 and color inks are ejected from nozzle rows 151 to 154 of color inks moving in the first direction, thereby the color image is formed on the recording medium S, and at the same time, the ultraviolet rays from ultraviolet irradiation unit 160*a* are irradiated to the color image formed at that time, thereby the color image is cured.

After the operation of FIG. 9A, as shown in FIG. 9B, the carriage 14 moves in the first direction with the first speed V1 and a clear layer is ejected from nozzle row 155 of a clear ink, which moves to the first direction, thereby the clear ink layer is formed on the color image of the recording medium S, and at the same time, the ultraviolet rays from ultraviolet irradiation unit 160*b* are irradiated to the clear ink layer formed at that time, thereby the clear ink layer is cured.

After the operation of FIG. 9B, as shown in FIG. 9C, in order to print the subsequent band width, the recording medium S moves in the second direction with the band width by the transporting roller 13.

Figure 10A:
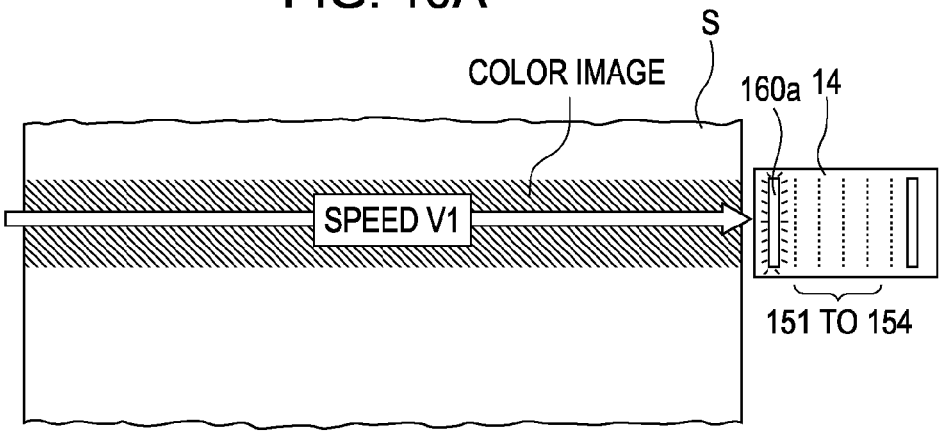
FIGS. 10A to 10C are diagrams illustrating printing operations by the printing apparatus according to the embodiment of the invention.
Figure 10B:
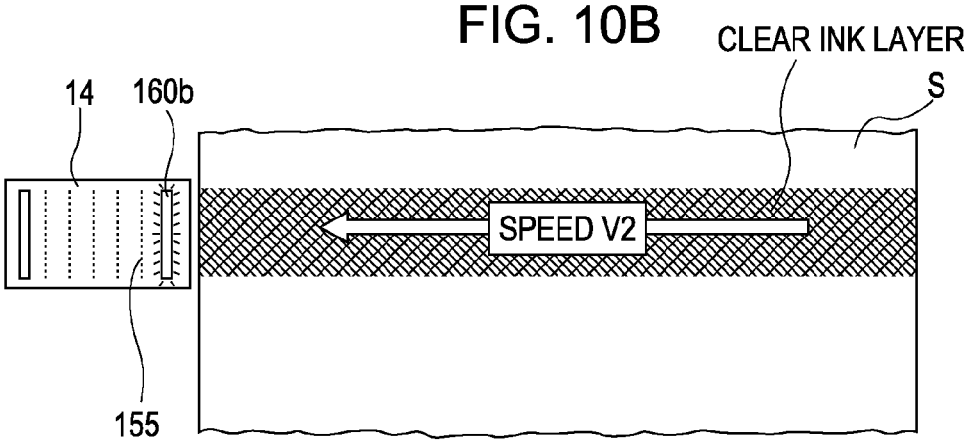
Figure 10C:
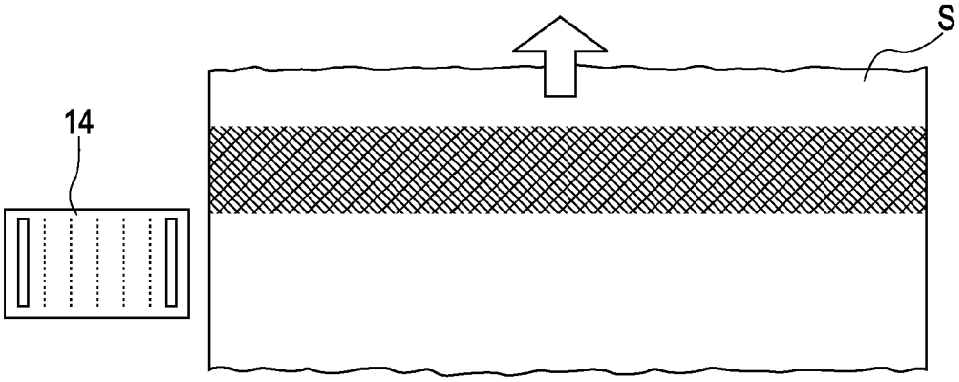

Meanwhile, FIGS. 10A to 10C show a printing operation using for forming an area having a glossiness in the image formed on the recording medium S.

In this case, firstly, as shown in FIG. 10A, the carriage 14 moves in a first direction with a first speed V1 and color inks are ejected from nozzle rows 151 to 154 of color inks moving in the first direction, thereby the color image is formed on the recording medium S, and at the same time, the ultraviolet rays from ultraviolet irradiation unit 160*a* are irradiated to the color image formed at that time, thereby the color image is cured.

After the operation of FIG. 10A, as shown in FIG. 10B, the carriage 14 moves in the first direction with a second speed V2 slower than the first speed V1 and a clear layer is ejected from nozzle row 155 of a clear ink moving to the first direction, thereby the clear ink layer is formed on the color image of the recording medium S, and at the same time, the ultraviolet rays from ultraviolet irradiation unit 160*b* are irradiated to the clear ink layer formed at that time, thereby the clear ink layer is cured.

After the operation of FIG. 10B, as shown in FIG. 10C, in order to print the subsequent band width, the recording medium S moves in the second direction with the band width by the transporting roller 13.

In a case where an area having a texture is formed on the image, when ejecting the clear ink from the nozzle row 155 and then curing the ejected ink to form a clear ink layer, the movement speed of the carriage 14 is the first speed V1 similar to when forming the color ink layer.

In contrast, in a case where an area having a glossiness is formed on the image, when ejecting the clear ink from the nozzle row 155 and then curing the ejected ink to form the clear ink layer, the movement speed of the carriage 14 is the second speed V2 slower than when forming the color ink layer. Thereby since further time for leveling is provided to the clear ink ejected on the recording medium S compared with the case where the movement speed of the carriage 14 is the first speed V1, it is possible to form an area having a glossiness in the image.

FIGS. 11A and 11B show a schematic diagram illustrating difference in surface state due to a difference in the movement speed of carriage 14 when irradiating ultraviolet rays as above. FIG. 11A shows a schematic diagram illustrating a state of the clear ink layer surface in a case where the carriage 14 moves with the first speed V1 when irradiating the clear ink layer by the ultraviolet irradiation unit 160, FIG. 11B shows a schematic diagram illustrating a state of a clear ink layer surface in a case where the carriage 14 moves with the second speed V2, when irradiating the clear ink layer by the ultraviolet irradiation unit 160.

With respect to the clear ink layer ejected, in a case where the clear ink layer is irradiated by the ultraviolet irradiation unit 160 moving with the first speed V1, before the clear ink layer is leveling evenly, the clear ink is cured, the surface layer of the clear ink layer has a convexo-concave state as shown in FIG. 11A and thus, it is possible to give a texture in the color image layer which is underneath.

Meanwhile, with respect to the ejected clear layer, in a case where the clear ink layer is irradiated by ultraviolet ray from the ultraviolet irradiation unit 160 moving with the second speed V2 slower than the first speed V1, since the clear ink layer is cured and at the same time, the leveling is performed in a substantial even, the surface layer of clear ink layer has a flat state as shown in FIG. 11B and thus, it is possible to give a glossiness in the color image layer which is underneath.

Further, in the embodiment, in order to obtain an image having a texture, the movement speed of the carriage in which the ultraviolet irradiation unit 160 is provided when curing the clear ink layer is the first speed V1 similar to when forming the color ink layer, but setting to a faster speed is also possible.

As above, in the printing apparatus and printing method of the invention, when ejecting the clear ink from the clear ink nozzle row to form the clear ink layer on the medium, since it is constituted such that the movement speed of the carriage 14 providing the ultraviolet irradiation unit 160 is able to change, it is possible, according to the printing apparatus and printing method of the invention, to mix an area having a texture with an area having a glossiness in the image so that the representation of the image provided by the printing apparatus can be diversified.

Next, other embodiment of the invention will be explained.

In the aforementioned embodiment, in a case where an area having a texture is formed on the image, the movement speed of the carriage 14 in which the ultraviolet irradiation unit 160 is provided is the first speed V1, and in a case where an area having a sense of glossiness is formed on the image, the movement speed of the carriage 14 in which the ultraviolet irradiation unit 160 is provided is the second speed V2 slower than the first speed V1, however, according to another embodiment, in addition to the movement speed of the carriage 14 like this, when forming the clear ink layer, it is possible to form an image further emphasizing the sense of texture and the sense of glossiness by using pixels having different sizes.

Referring again to FIGS. 9A to 9C and FIGS. 10A to 10C, the image formation operation in the other embodiment will be explained.

Although FIGS. 9A to 9C show a printing operation using for forming the area having a sense of texture in the image formed on the recording medium S, firstly, as shown in FIG. 9A, the carriage 14 moves in a first direction with a first speed V1 and the color inks are ejected from nozzle rows 151 to 154 of color inks moving in the first direction, thereby the color image is formed on the recording medium S and at the same time, the ultraviolet rays from ultraviolet irradiation unit 160*a* are irradiated to the color image formed at that time, thereby the color image is cured. In the printing operation of FIG. 9A, the color ink layer uses a pixel size based on the instruction according to printing data PD.

After the operation of FIG. 9A, as shown in FIG. 9B, the carriage 14 moves in the first direction with the first speed V1 and a clear ink layer is ejected from nozzle row 155 of a clear ink moving to the first direction, thereby the clear ink layer formed on the color image of the recording medium S and at the same time, the ultraviolet rays from ultraviolet irradiation unit 160*b* are irradiated to the clear ink layer formed at that time, thereby the clear ink layer is cured. In the printing operation in FIG. 9B, the clear ink layer uses the smallest sized pixel, for example which the apparatus can process.

After the operation of FIG. 9B, as shown in FIG. 9C, in order to print the subsequent band width, the recording medium S moves in the second direction by the band width by the transporting roller 13.

Meanwhile, FIGS. 10A to 10C show a printing operation using for forming the area having sense of glossiness in the image formed on the recording medium S.

In this case, firstly, as shown in FIG. 10A, the carriage 14 moves in the first direction with the first speed V1 and the color inks are ejected from nozzle rows 151 to 154 of color inks moving in the first direction, thereby the color image is formed on the recording medium S, and at the same time, the ultraviolet rays from ultraviolet irradiation unit 160*a* are irradiated to the color image formed at that time, thereby the color image is cured. In the printing operation in FIG. 10A, the color ink layer uses a pixel size based on the instruction by printing data PD.

After the operation of FIG. 10A, as shown in FIG. 10B, the carriage 14 moves in the first direction with the second speed V2 slower than the first speed V1 and a clear ink is ejected from nozzle row 155 of a clear ink moving to the first direction, thereby the clear ink layer is formed on the color image of the recording medium S and at the same time, the ultraviolet rays from ultraviolet irradiation unit 160*b* are irradiated to the clear ink layer formed at that time, thereby the clear ink layer is cured. In the printing operation in FIG. 10B, the clear ink layer uses the largest sized pixel, for example which the apparatus can process.

After the operation of FIG. 10B, as shown in FIG. 10C, in order to print the subsequent band width, the recording medium S moves in the second direction by the band width by the transporting roller 13.

Figure 12A:
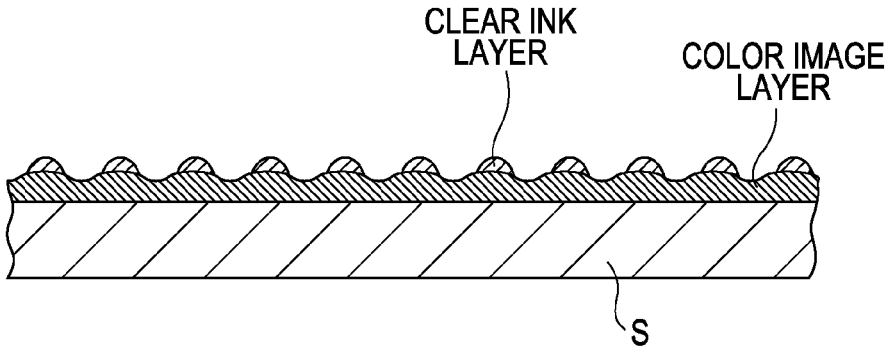
FIGS. 12A and 12B are diagrams illustrating printing operations by the printing apparatus according to another embodiment of the invention.
Figure 12B:
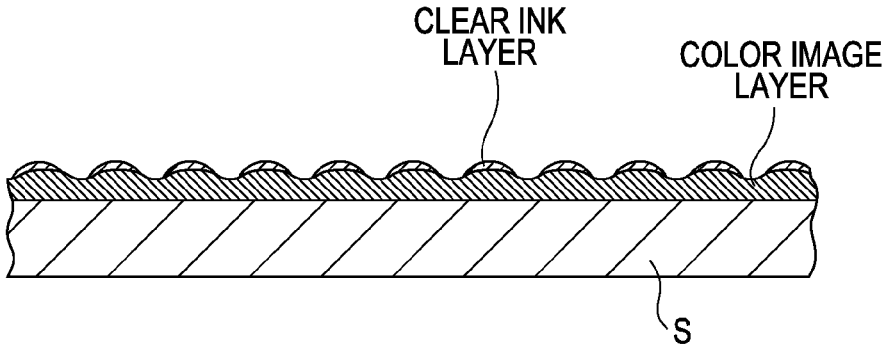

FIGS. 12A to 12C show another embodiment of invention as a schematic diagram illustrating a surface state, based on printing operation used for forming the image having a sense of texture by the printing apparatus 10.

FIG. 12A represents a state in which the clear ink layer is formed from the smallest sized pixel which the apparatus can process.

FIG. 12B shows a schematic diagram illustrating a state of a clear ink layer surface in a case where a carriage moves with the first speed V1, when irradiating the clear ink layer consisting of a smallest sized pixel by the ultraviolet irradiation unit 160.

As shown in FIGS. 12*a* to 12C, according to another embodiment, the movement speed of the carriage 14 is the first speed and the pixel size is the smallest sized pixel when forming clear ink layer, thereby it is possible to form an image further emphasizing the sense of texture.

Figure 13A:
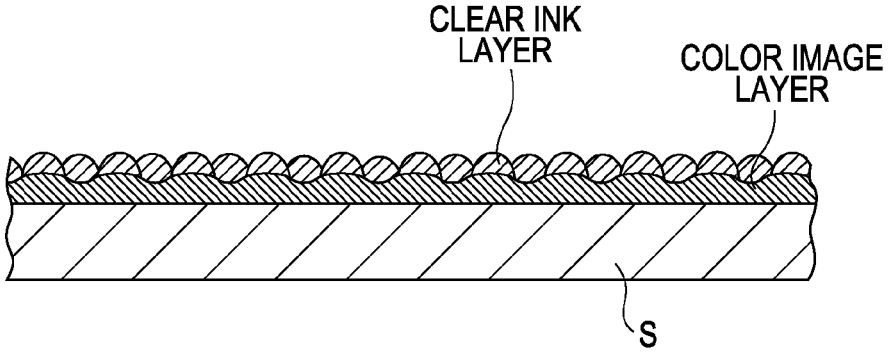
FIGS. 13A and 13B are diagrams illustrating printing operations by the printing apparatus according to other embodiment of the invention.
Figure 13B:
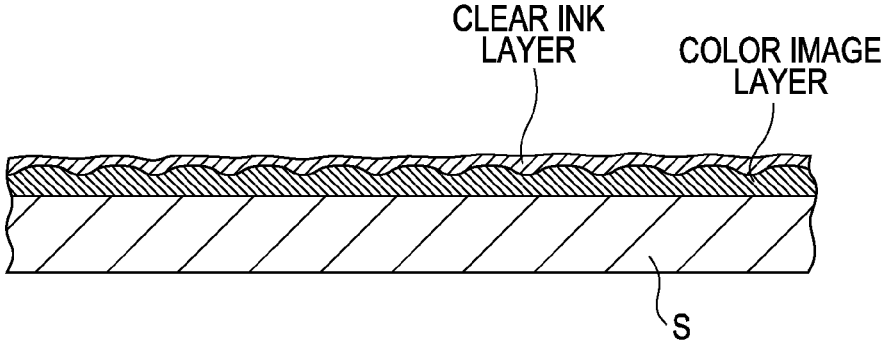

FIGS. 13A and 13B show another embodiment of the invention as a schematic diagram illustrating a surface state, based on the printing operation using for forming the image having a sense of texture by the printing apparatus 10.

FIG. 13A represents a state that the clear ink layer is formed from the largest sized pixel which the apparatus is obtained by processing.

FIG. 13B shows a schematic diagram illustrating a state of a clear ink layer surface in a case where carriage moves with the second speed slower than the first speed V1, when irradiating the clear ink layer consisting of the largest sized pixel by the ultraviolet irradiation unit 160.

As shown in FIGS. 13A and 13B, according to another embodiment, the movement speed of the carriage 14 is the second speed and the pixel size is the largest sized pixel when forming clear ink layer, thereby it is possible to form an image further emphasizing glossiness since relatively large amount of clear ink remains in leveling over time.

As above, according to each embodiment of the invention, although the movement speed of carriage is controlled, as another embodiment of the invention, the invention is no limited to a movable carriage. For example, it is possible to adapt to so-called a line head type printing apparatus such that the head is disposed along the width direction of the medium such as for example, paper which an ejection target. In such a case, it is possible to implement the embodiment of the invention by controlling/adjusting the time (for example, the second time is longer than the first time) between a first time required to perform a first operation from the ejecting of clear ink from the line head to the curing of the ejected clear ink and a second time required to perform a second operation from the ejecting of the color ink from the line head to the curing of the ejected color ink. In that case, a first light irradiation section using for the first operation and a second light irradiation section using for the second operation should be separately provided, and a first distance from the first irradiation section to the color ink ejection nozzle and a second distance from the second irradiation section to the clear ink ejection nozzle should be set appropriately (for example, each nozzle and light irradiation section are disposed so that the second distance is longer than the first distance).

The entire disclosure of Japanese Patent Application No. 2011-163100, filed on Jul. 26, 2011 is expressly incorporated by reference herein.

What is claimed is:

1. A printing apparatus comprising:

a carriage that is movable in a first direction with respect to a medium;

a recording head that is provided in the carriage and ejects color inks or a clear ink which are irradiated with light and cured;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction;

a light irradiating section that is provided in the carriage and irradiates light; and a controller, wherein the controller controls to perform a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured, and the first operation is different in movement speed of the carriage from the second operation.

2. A printing apparatus comprising:

a carriage movable in the first direction with respect to the medium;

a recording head that is provided in the carriage and ejects color inks or a clear ink which are irradiated with light and cured;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction;

a light irradiating section that is provided in the carriage and irradiates light; and a controller, wherein the controller controls to perform a first operation in which the carriage moves in the first direction with a first speed and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction with a second speed slower than the first speed and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured.

3. A printing apparatus comprising:

a carriage that is movable in a first direction with respect to a medium;

a recording head that is provided in the carriage and ejects color inks or a clear ink which are irradiated with light and cured and is able to form a different size of pixel;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction;

a light irradiating section that is provided in the carriage and irradiates light; and a controller, wherein the controller controls to perform a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time to cure the clear ink layer, thereby forming an image of a largest sized pixel which is obtained by processing in the second operation, the first operation is different in movement speed of the carriage from the second operation.

4. A printing method using:

a carriage that is movable in a first direction with respect to a medium;

a recording head that is provided in the carriage and ejects color inks or a clear ink which are irradiated with light and cured;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction; and a light irradiating section that is provided in the carriage and irradiates light, the method comprises;

a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured, and the first operation is different in movement speed of the carriage from the second operation.

5. A printing method using:

a carriage that is movable in a first direction with respect to a medium;

a recording head that is provided in the carriage and ejects color inks or a clear ink which are irradiated with light and cured;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction; and a light irradiating section that is provided in the carriage and irradiates light, the method comprises;

a first operation in which the carriage moves in the first direction with a first speed and color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction with a second speed slower than the first speed and clear ink is ejected from the clear ink nozzle row moving in the first direction, thereby a clear ink layer is formed on the medium, and at the same time, the light from the light irradiation section is irradiated to the clear ink layer formed at that time, thereby the clear ink layer is cured.

6. A printing method using:

a carriage that is movable in a first direction with respect to a medium;

a recording head that is provided in the carriage and ejects color inks or a clear ink which are irradiated with light and cured and is able to form a different size of pixel;

color ink nozzle rows that are provided in the recording head and ejects the color inks which are irradiated with light and cured;

a clear ink nozzle row that is provided in the recording head and ejects the clear ink which is irradiated with light and cured;

a moving mechanism that causes the medium to move relatively in a second direction intersecting the first direction; and a light irradiating section that is provided in the carriage and irradiates light, the method comprises;

a first operation in which the carriage moves in the first direction and the color inks are ejected from the color ink nozzle rows moving in the first direction, thereby the color image is formed on the medium, and at the same time, the light from the light irradiation section is irradiated to the color image formed at that time, thereby the color image is cured, and after the first operation, a second operation in which the carriage moves in the first direction and the clear ink is ejected from the clear ink nozzle row moving in the first direction, thereby a clear ink layer is formed on the medium, and at the same time, the light from the light irradiation section is irradiated to the clear ink layer formed at that time to cure the clear ink layer, thereby forming a largest sized pixel which is obtained by processing in the second operation, the first operation is different in movement speed of the carriage from the second operation.

* * * * *